US008600090B2

(12) United States Patent
Hies et al.

(10) Patent No.: US 8,600,090 B2
(45) Date of Patent: Dec. 3, 2013

(54) HEARING AID AND IN-THE-EAR-DEVICE

(75) Inventors: Thomas Hies, Singapore (SG); Harald Klemenz, Fürth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 83 days.

(21) Appl. No.: 13/256,272

(22) PCT Filed: Mar. 13, 2009

(86) PCT No.: PCT/SG2009/000087

§ 371 (c)(1),
(2), (4) Date: Sep. 13, 2011

(87) PCT Pub. No.: WO2010/104469

PCT Pub. Date: Sep. 16, 2010

(65) Prior Publication Data

US 2012/0020507 A1 Jan. 26, 2012

(51) Int. Cl.
*H04R 25/00* (2006.01)

(52) U.S. Cl.
USPC ..... 381/328; 381/312; 381/322

(58) Field of Classification Search
USPC ..... 381/312, 322, 324, 328
See application file for complete search history.

(56) References Cited

U.S. PATENT DOCUMENTS

| | | | | |
|---|---|---|---|---|
| 5,440,082 | A * | 8/1995 | Claes | 181/135 |
| 5,742,692 | A | 4/1998 | Garcia et al. | |
| 6,052,473 | A * | 4/2000 | Clavadetscher et al. | 381/322 |
| 6,393,130 | B1 * | 5/2002 | Stonikas et al. | 381/322 |
| 7,039,208 | B2 * | 5/2006 | Wagner et al. | 381/322 |
| 7,844,065 | B2 * | 11/2010 | von Dombrowski et al. | 381/328 |
| 2001/0043707 | A1 | 11/2001 | Leedom | |
| 2007/0071265 | A1 | 3/2007 | Leedom | |
| 2008/0181441 | A1 * | 7/2008 | Smith | 381/328 |
| 2008/0317269 | A1 * | 12/2008 | Tipsmark et al. | 381/322 |

FOREIGN PATENT DOCUMENTS

| | | | |
|---|---|---|---|
| WO | 9528066 | A1 | 10/1995 |
| WO | 0169971 | A2 | 9/2001 |

* cited by examiner

*Primary Examiner* — Curtis Kuntz
*Assistant Examiner* — David J Ho
(74) *Attorney, Agent, or Firm* — Laurence A. Greenberg; Werner H. Stemer; Ralph E. Locher

(57) ABSTRACT

A hearing aid may include a hearing aid housing. The hearing aid housing may include a first housing wall portion and a second housing wall portion. The first housing wall portion has a first flexibility, the second housing wall portion has a second flexibility and the first flexibility is different than the second flexibility.

19 Claims, 6 Drawing Sheets

HEARING AID AND IN-THE-EAR-DEVICE

BACKGROUND OF THE INVENTION

Field of the Invention

Embodiments relate generally to an in-the-ear device.

In a conventional in-the-ear (ITE) hearing aid including an in-the-ear device, the housing usually includes housing shells completely having the same flexibility, e.g. completely hard (and thus inflexible) housing shells (which sometimes may be provided with a soft cover) or completely soft custom made housing shells. Depending on the quality of the manufacturing, and depending on the quality of the ear imprint, these shells usually fit well or not so well into the ear canal.

This may cause problems (e.g. this may cause too tight or too loose fitting) for the user of the hearing aid including the in-the-ear device in specific locations of the ear canal. In order to reduce these problems, in a conventional hearing aid including the in-the-ear device, material is usually added or removed in these portions of the housing shells which correspond to the above mentioned specific locations of the ear canal of the user when the user wears the hearing aid. However, the problems may still remain and a conventional hearing aid faces the problem of little acceptance of the users due to e.g. a bad fitting of the hearing aid to the ear canal, e.g. a too loose fitting or a too tight fitting.

BRIEF SUMMARY OF THE INVENTION

The object of the invention may be seen to provide an in-the-ear device having improved fitting characteristics for a user.

The object is achieved by an in-the-ear device having the features of the independent claim.

In an embodiment, a hearing aid is provided. The hearing aid may include a hearing aid housing. The hearing aid housing may include a first wall portion of the housing and a second wall portion of the housing, wherein the first wall portion of the housing has a first flexibility and the second wall portion of the housing has a second flexibility, and wherein the first flexibility is different from the second flexibility.

In various embodiments, the wall portions of the housing having different flexibilities provides an easy and cost-efficient way to flexibly adapt the shape of the housing wall of a hearing aid to the physical characteristics of the user's ear. Thus, a very accurate user specific adaptation of the hearing aid may be provided without it being necessary to manually adapt the shape of the hearing aid housing wall after selling it.

The hearing aid may be an in-the-ear (ITE) hearing aid. Alternatively, the hearing aid may be a behind-the-ear (BTE) hearing aid. Alternatively, the hearing aid can be located anywhere in the ear and can have any shape, e.g. Siemens Vibe (which is located not in the ear canal or behind the ear, but rather in the concha of the ear). Alternatively, the part can be an ear mould or special versions of ear moulds e.g. open version, special venting, active moulds, moulds including parts of the hearing aid like receiver and cerumen protection system.

The first wall portion of the housing and/or the second wall portion of the housing of the hearing aid may include or consist of plastic material. The plastic material of the first wall portion of the housing of the hearing aid and/or the plastic material of the second wall portion of the housing of the hearing aid may include or consist of at least one of the materials listed in the following table:

| | | |
|---|---|---|
| ObJet Eden/PolyJet | TangoPlus | 27 |
| | TangoGrey | 75 |
| | TangoBlack | 61 |
| | VeroWhite | 83 |
| | DurasWhite | 76 |
| Envisiontec Perfactory | Eshell 100 | 83 |
| | Eshell 200 | 83 |
| | R11 | 87 |
| | SI500 | 85 |
| | Y8 | 78 |
| | RC25 | 93 |
| 3D Systems Viper | Accura 10 | 86 |
| | Accura 40 | 84 |
| | FotoTec SLC | 80-84 |
| | FotoTec SLD | 80-84 |

In other words, the plastic material of the first wall portion of the housing of the hearing aid and/or the plastic material of the second wall portion of the housing of the hearing aid may include or consist of at least one of the following materials: Tango Plus, Eshell, R11, Y0, Accura 10, Accura 40 FotoTec, Vero White with shore hardness from e.g. 1 up to 100 and shore hardness difference between the materials from 1 to 99.

The first wall portion of the housing of the hearing aid and/or the second wall portion of the housing of the hearing aid may be formed of bio-compatible material.

Using bio-compatible material may be provided e.g. in those wall portions of the housing which are in direct physical contact with the user's skin when the user is wearing the hearing aid. By way of example, the bio-compatible material may be provided in an ITE hearing aid in that/those wall portion(s) being in direct physical contact with e.g. the ear canal wall when the ITE hearing aid is inserted into the ear canal. In another example, e.g. in case the hearing aid is implemented as a BTE hearing aid, the bio-compatible material may be provided in the portion(s) being in direct physical contact with e.g. the backside of the ear conch when being worn by a user, or alternatively, the bio-compatible material may be provided in the portion(s) being in direct physical contact with e.g. the ear conch of the user.

The first flexibility of the first wall portion of the housing of the hearing aid may be smaller than the second flexibility of the second wall portion of the housing of the hearing aid, thus providing a good fit that is neither too loose nor too tight due to the increased flexibility within the housing acting like a joint that enables the housing to adapt to the user's ear canal without the need to add or remove material like in conventional systems.

The first wall portion of the housing of the hearing aid may be formed of a first material, while the second wall portion of the housing may be formed of a second material; thereby, the first material may be different from the second material. This first material may include or consist of plastic material; and the second material may include or consist of rubber material such as e.g. silicon rubber, Tango Plus, Eshell, R11, Y0, Accura 10, Accura 40 FotoTec, Vero White with shore hardness from e.g. 1 up to 100 and shore hardness difference between the materials from 1 to 99.

The first material may include or consist of plastic material while the second material may include or consist of curable material such as e.g. Tango Plus, Eshell, R11, Y0, Accura 10, Accura 40 FotoTec, Vero White with shore hardness from e.g. 1 up to 100 and shore hardness difference between the materials from 1-99.

The first wall portion of the housing of the hearing aid may include a first wall structure, while the second wall portion of the housing of the hearing aid may include a second wall structure. This first wall structure may be different from the second wall structure, thereby providing different flexibilities, and thus providing another possibility of enabling adaptation of the housing to the user's ear canal due to its intrinsic flexibility and therefore a better and more comfortable fit in the user's ear canal, which may lead to a better acceptance of the hearing aid by eliminating the problematic locations, and consequently, to less returns of the product. The second wall structure of the second wall portion of the housing of the hearing aid may include at least one of the following types of wall structures: a grid structure, a pore structure, and a meander structure.

The second wall portion of the housing may include a plurality of layers. By way of example, at least one layer of this plurality of layers may include at least one of the following types of wall structure: a grid structure; a pore structure; and a meander structure.

In various embodiments, the first wall portion of the housing of the hearing aid may have a different physical thickness than the second wall portion of the housing of the hearing aid.

The second wall portion may be provided by covering a notch or hole (e.g. through hole) or opening in the first wall portion of the housing and at least a portion of the first wall portion with a coating, e.g. a flexible coating, e.g. a flexible membrane. The coating may include or consist of at least one of the following materials: Tango Plus, Eshell, R11, Y0, Accura 10, Accura 40 FotoTec, Vero White with shore hardness from e.g. 1 up to 100 and shore hardness difference between the materials from 1 to 99.

A portion of the second wall portion of the housing is a contacting portion of a housing surface which may be configured to provide a physical contact with a skin of a user, when worn by the user. The contacting portion may be provided as a contacting portion configured to provide a physical contact, when worn by the user, with a front portion of an ear conch of the user, with an ear canal of the user, and with a back portion of an ear conch of the user.

BRIEF DESCRIPTION OF THE SEVERAL VIEWS OF THE DRAWING

In the drawings, like reference characters generally refer to the same parts throughout the different views. The drawings are not necessarily to scale, emphasis instead generally being placed upon illustrating the principles of various embodiments. In the following description, various embodiments are described with reference to the following drawings, in which.

DESCRIPTION OF THE INVENTION

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, logical, and electrical changes may be made without departing from the scope of the invention. The various embodiments are not necessarily mutually exclusive, as some embodiments can be combined with one or more other embodiments to form new embodiments.

Figure 1:
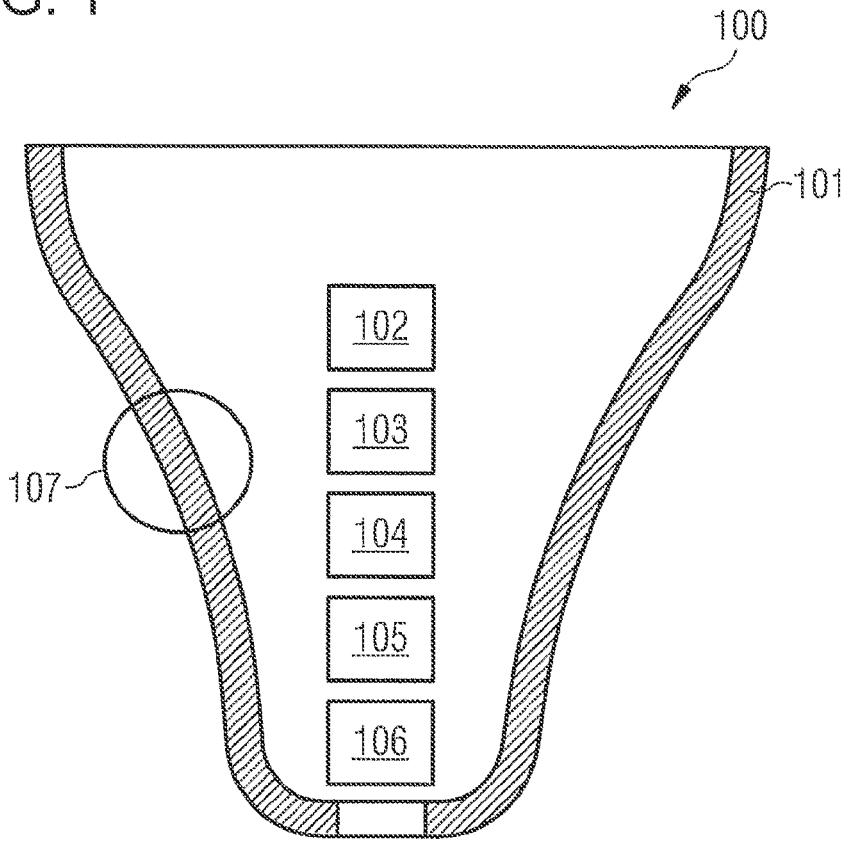
FIG. 1 shows a schematic drawing of an in-the-ear hearing aid in accordance with an embodiment.

FIG. 1 shows a schematic drawing of a hearing aid 100, in this example implemented as an in-the-ear hearing aid 100 in accordance with an embodiment.

Referring to FIG. 1, the in-the-ear (ITE) hearing aid 100 according to an embodiment may include a housing 101. In various embodiments, the housing 101 may accommodate one or more microphones 102, a speaker 103 (in the following also referred to as a receiver 103), a processing circuit 104, a power-on/power-off button 105, and a battery case 106 configured to receive one or more batteries (not shown in the figures). The components 102, 103, 104, 105, 106 may be electrically coupled with each other e.g. by means of an electrical connection such as e.g. one or more cables or electrical wires. Reference number 107 designates a portion of the wall of the housing 101 which will be explained in more detail below in respect to various possible implementations thereof which are shown in greater detail in FIG. 2 to FIG. 8.

Referring to FIG. 1, portions of the surface of the housing wall of the housing 101 may be designated to function as contacting portions which provide physical contact to portions of the skin of a user when the hearing aid is worn by a user. The portions of the housing wall surface which provide physical contact to the skin of a user when worn by a user may include or consist of a variety of materials.

In various embodiments, the portions of the housing wall surface providing physical contact to a user's skin may include or consist of at least one of the following materials: plastic material, curable material, rubber material (e.g. silicon rubber), bio-compatible material and coating material.

Figure 2:
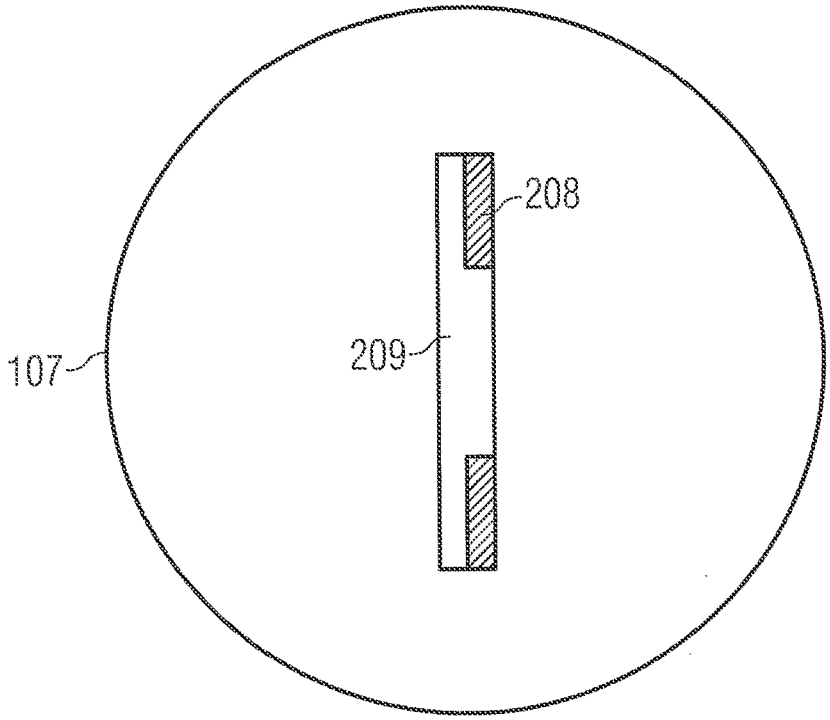
FIG. 2 shows an enlarged sectional view of the in-the-ear hearing aid of FIG. 1, depicting the assembly of the first portion of the wall of the housing and the second portion of the wall of the housing in accordance with an embodiment in more detail.

FIG. 2 shows the enlarged sectional view of an assembly 107 of an implementation of a first portion of the wall and a second portion of the wall of the housing of the hearing aid of FIG. 1 in more detail.

Referring to FIG. 2, the assembly 107 may include a portion of the wall of the housing 101 shown in more detail, wherein the wall of the housing 101 may include a first wall portion 208 of the housing 101 and a second wall portion 209 of the housing 101. In this implementation, the first wall portion 208 of the housing 101 may have a flexibility that is smaller than the flexibility of the second wall portion 209 of the housing 101. According to this implementation, the first wall portion 208 of the housing 101 may provide a hard shell for the housing 101 for safely accomodating the electronic devices as shown in FIG. 1, while the second wall portion 209 of the housing 101 may provide a more flexible joint that enables the housing to adapt to the user's ear canal without the need to add or remove material like in a conventional hearing aid system, thus providing a good fit that is neither too loose nor too tight due to the increased flexibility within the housing 101.

Referring to FIG. 2, the first wall portion 208, having a flexibility that is smaller than the flexibility of the second wall portion 209, may face the inside of the hearing aid housing 101, thus providing the hard shell of the housing 101 for accommodating the electronic components. The second wall portion 209, having a flexibility that is greater than the flexibility of the first wall portion 208, may face the outside of the hearing aid housing 101, thus providing a more flexible and thereby a smoother portion of the housing wall surface. Thus, the second wall portion 209 may provide its function as contacting portion which provides physical contact to portions of the skin of a user when the hearing aid is worn by a user.

Referring to FIG. 2, the first wall portion 208 may have a gap or a notch or an opening or a hole, e.g. a through hole. The second wall portion 209 facing the outside of the hearing aid housing 101 may be provided for covering portions of the first wall portion 208 such, that the opening within the first wall portion 208 is filled with a portion of the material of the second wall portion 209 and that the second wall portion 209 covering the first wall portion 208 may allow for a smooth and flexible contacting portion where at locations where the housing wall surface contacts the skin of a user in an ear canal of the user.

The first wall portion 208 may include or consist of a different material than the second wall portion 209, thus providing for the different flexibilities of the wall portions.

Figure 3:
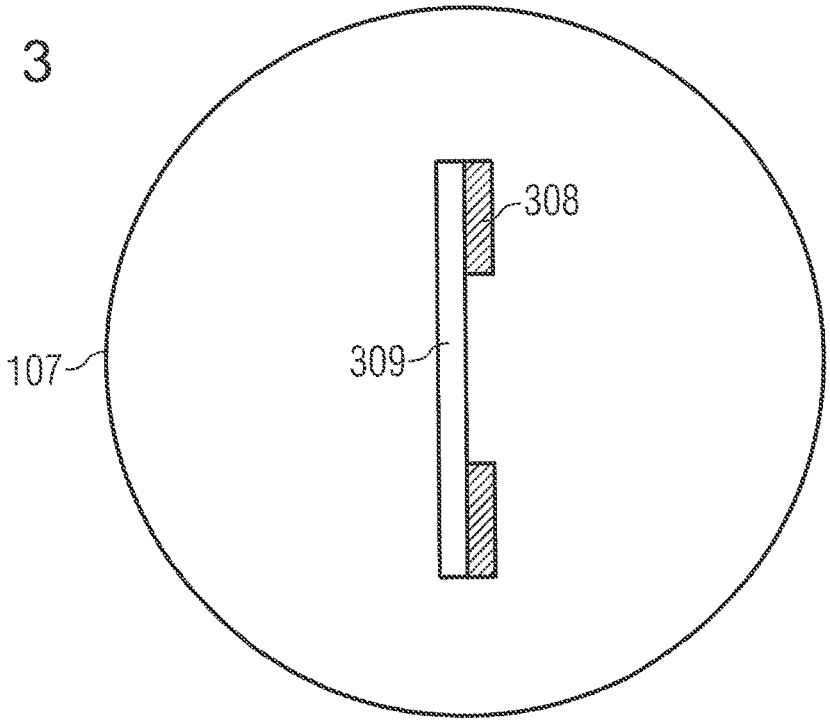
FIG. 3 shows an enlarged sectional view of the in-the-ear hearing aid of FIG. 1, depicting the assembly of the first portion of the wall of the housing and the second portion of the wall of the housing in accordance with another embodiment in more detail.
Figure 4:
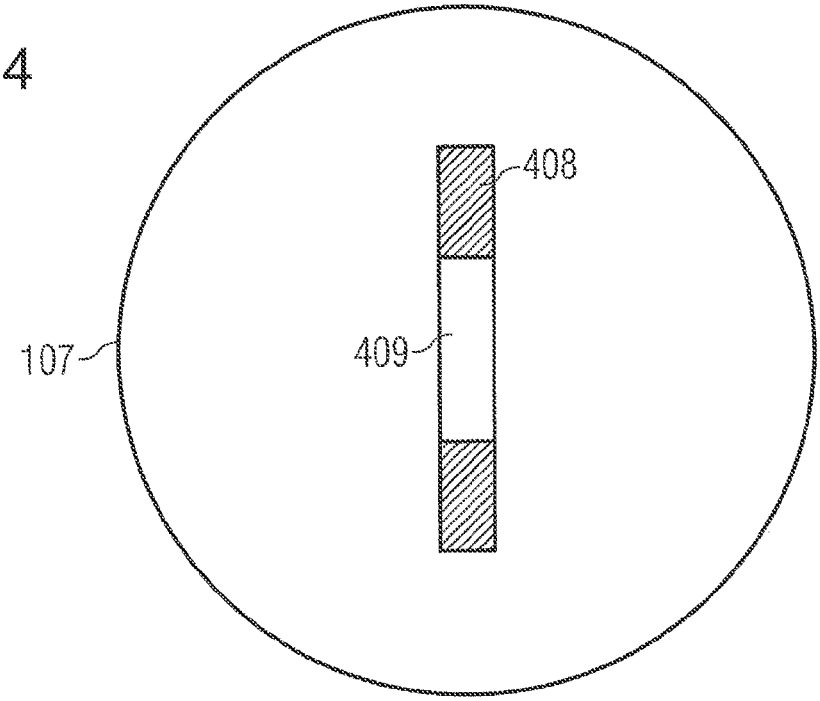
FIG. 4 shows an enlarged sectional view of the in-the-ear hearing aid of FIG. 1, depicting the assembly of the first portion of the wall of the housing and the second portion of the wall of the housing in accordance with yet another embodiment in more detail.
Figure 5:
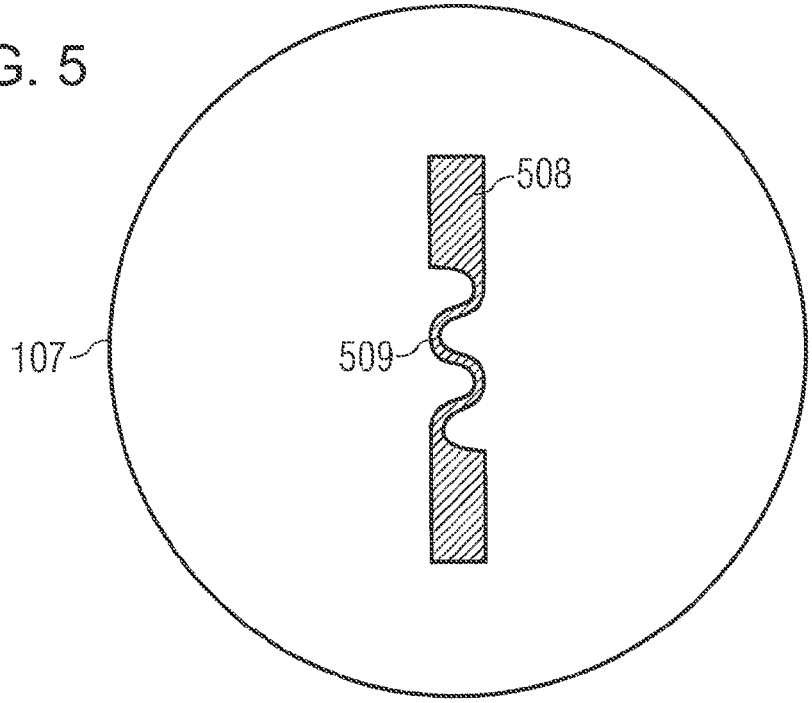
FIG. 5 shows an enlarged sectional view of the in-the-ear hearing aid of FIG. 1, depicting the assembly of the first portion of the wall of the housing and the second portion of the wall of the housing in accordance with yet another embodiment in more detail.

FIG. 3 to FIG. 5 show enlarged sectional views of various other implementations of the assembly 107 of the first portion of the wall and the second portion of the wall of the housing 101 of the hearing aid of FIG. 1 in more detail. In every embodiment, the first wall portion (308, 408, and 508, respectively) may provide a hard shell for the housing 101, as described referring to FIG. 2, while a portion of the second wall portion (309, 409, and 509, respectively) may provide the more flexible joint.

Referring to FIG. 3, the first wall portion 308 having a flexibility that is smaller than the flexibility of the second wall portion 309, may face the inside of the hearing aid housing 101, thus providing the hard shell of the housing 101 for accommodating the electronic components. The second wall portion 309, having a flexibility that is greater than the flexibility of the first wall portion 308, may face the outside of the hearing aid housing 101, thus providing a more flexible and thereby a smoother portion of the housing wall surface. Thus, the second wall portion 309 may provide its function as contacting portion which provides physical contact to portions of the skin of a user when the hearing aid is worn by a user.

Referring to FIG. 3, the first wall portion 308 may have a gap or a notch or an opening or a hole, e.g. a through hole or a blind hole. The second wall portion 309 facing the outside of the hearing aid housing 101 may be provided for covering portions of the first wall portion 308 such that the opening within the first wall portion 308 is unfilled with a portion of the material of the second wall portion 309, thus leading to a step portion between the first wall portion 308 and the second wall portion 309 within the surface of the housing wall, and that the second wall portion 309 covering the first wall portion 308 may allow for a smooth and flexible contacting portion at locations where the housing wall surface contacts the skin of a user when worn by a user.

The first wall portion 308 may include or consist of a different material than the second wall portion 309, thus providing for the different flexibilities of the wall portions.

Referring to FIG. 4, the first wall portion 408 may have a gap or a notch or an opening or a hole, e.g. a through hole or a blind hole. The second wall portion 409 may be provided for in such a way that the opening within the first wall portion 408 is filled with a portion of the material of the second wall portion 409 such that the second wall portion 409 may provide for a flexible joint portion without covering additional portions of the first wall portion 408. In this implementation, no step portion is provided between the first wall portion 408 and the second wall portion 409 within the surface of the housing wall.

Thus, referring to FIG. 4, the first wall portion 408, having a flexibility that is smaller than the flexibility of the second wall portion 409, need not be covered by portions of the second wall portion material. Thus, the first wall portion 408 may face the inside of the hearing aid housing 101 as well as the outside of the hearing aid housing 101, thus providing the shell of the housing 101 for accommodating the electronic components. The second wall portion 409 having a flexibility that is greater than the flexibility of the first wall portion 408 may face the inside of the hearing aid housing 101 as well and the outside of the hearing aid housing 101 at those portions of the first wall portion 408, where there is an opening, thus providing a flexible portion of the housing wall by which a joint-like portion is achieved.

The first wall portion 408 may include or consist of a different material than the second wall portion 409, thus providing for the different flexibilities of the wall portions.

Referring to FIG. 5, the second wall portion 509 of the housing 101, which may have a greater flexibility than the first wall portion 508, may be implemented by providing a portion within the first wall portion 508 of the housing 101, wherein the material of the first wall portion 508 is provided having a smaller physical thickness than at other portions of the first wall portion 508, and/or by structuring this portion of smaller physical thickness in a meander structure.

Thus, referring to FIG. 5, the first wall portion 508 faces the inside of the hearing aid housing 101 as well as the outside of the hearing aid housing 101, thus providing the hard shell of the housing 101 for accommodating the electronic components as shown in FIG. 1. The second wall portion 509, having a flexibility that is greater than the flexibility of the first wall portion 508, may face the inside of the hearing aid housing 101 as well and the outside of the hearing aid housing 101 at those locations, where the material is provided in smaller physical thickness, thus providing a flexible portion of the housing wall by which a joint-like portion is achieved.

In another implementation, the second wall portion may be provided by covering a notch or hole (e.g. a through hole or a blind hole) or opening in the first wall portion of the housing and at least a portion of the first wall portion with a coating, e.g. a flexible coating, e.g. a flexible membrane. The coating may include or consist of at least one of the following materials: Tango Plus, Eshell, R11, Y0, Accura 10, Accura 40

FotoTec, Vero White with shore hardness from e.g. 1 up to 100 and shore hardness difference between the materials from 1 to 99.

Figure 6:
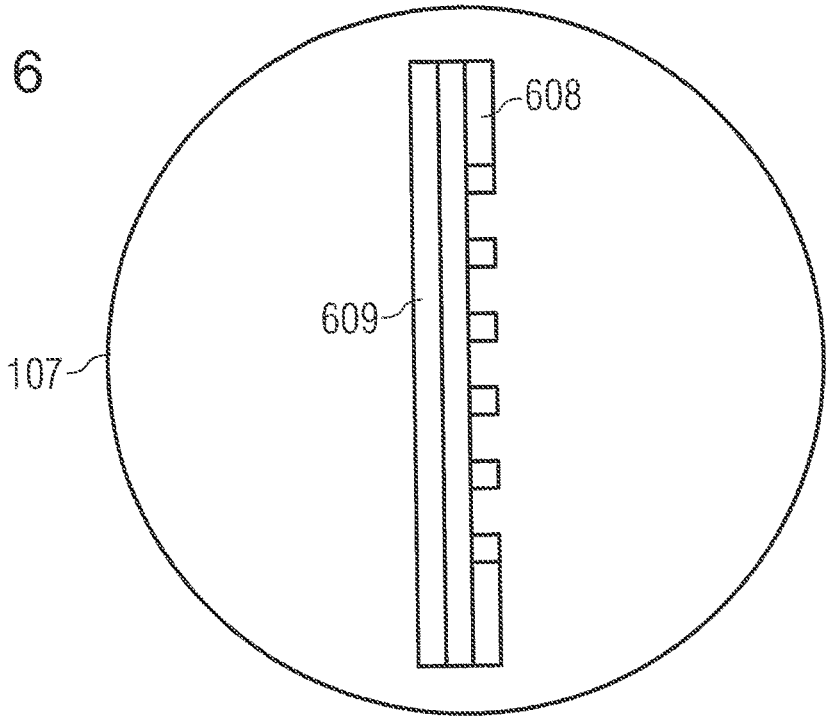
FIG. 6 shows an enlarged view of the second wall portion including a plurality of layers including a grid structure in accordance with an embodiment.
Figure 7:
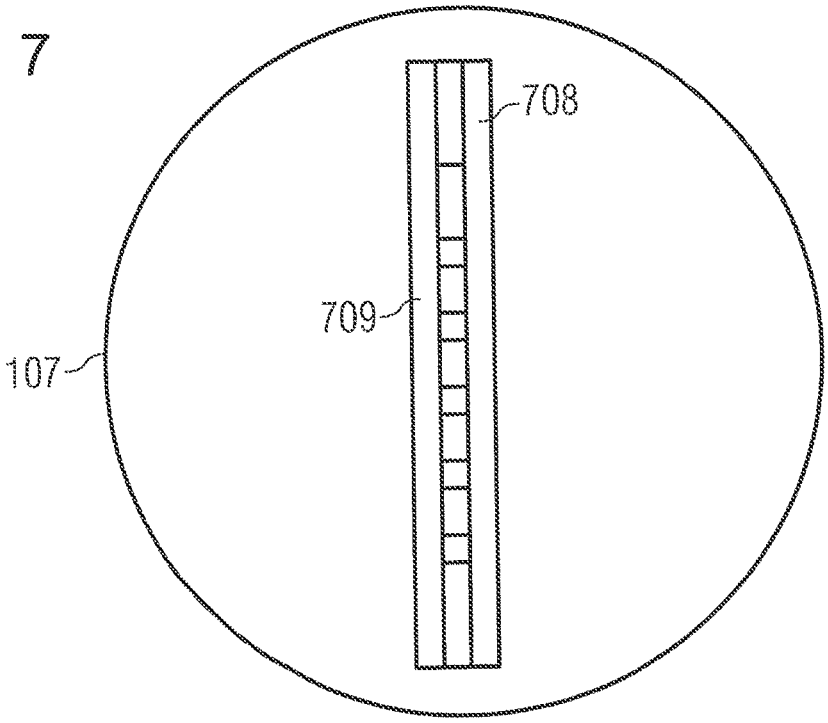
FIG. 7 shows an enlarged view of another embodiment of the second wall portion including a plurality of layers having a pore structure.
Figure 8:
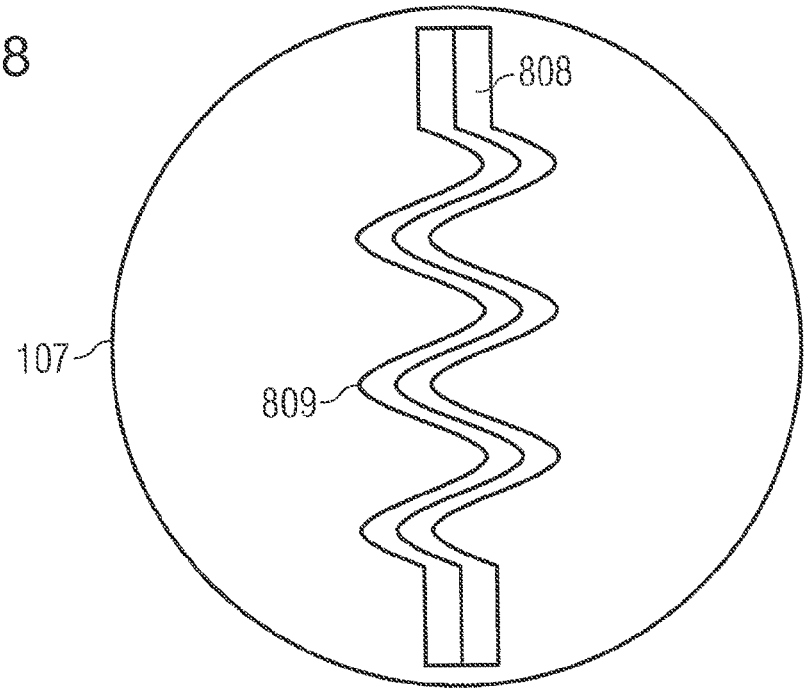
FIG. 8 shows an enlarged view of still another embodiment of the second wall portion including a plurality of layers having a meander structure.

FIG. 6 to FIG. 8 show enlarged sectional views of the assembly 107 of other implementations of the first wall portion and of the second wall portion of the housing 101 of the hearing aid of FIG. 1 in more detail. In each of those implementations, the first wall portion (608, 708, and 808, respectively) may provide a hard shell for the housing 101, as described referring to FIG. 2, while a portion of the second wall portion (609, 709, and 809, respectively) may provide the more flexible joint. In each of those implementations, the housing wall may be provided by including a plurality of layers.

Referring to FIG. 6 to FIG. 8, the assembly 107 may include a portion of the wall of the housing 101 shown in more detail, wherein the wall of the housing 101 may include a first wall portion 608, 708, and 808, respectively, of the housing 101 and a second wall portion 609, 709, and 809, respectively, of the housing 101. In these implementations, the first wall portion 608, 708, and 808, respectively, of the housing 101 may have a flexibility that is smaller than the flexibility of the second wall portion 609, 709, and 809, respectively, of the housing 101. According to these implementations, the first wall portion 608, 708, and 808, respectively, of the housing 101 may provide a hard shell for the housing 101 for safely accommodating the electronic devices as shown in FIG. 1, while the second wall portion 609, 709, and 809, respectively, of the housing 101 may provide a more flexible joint that enables the housing to adapt to the user's ear canal without the need to add or remove material like in a conventional hearing aid system, thus providing a good fit that is neither too loose nor too tight due to the increased flexibility within the housing 101.

Referring to FIG. 6, the greater flexibility of the second wall portion 609 having a plurality of layers compared to the flexibility of the first wall portion 608 also having a plurality of layers may be implemented by providing a plurality of layers, wherein at least one layer may include a grid structure within the second wall portion 609 of the housing.

Referring to FIG. 7, the greater flexibility of the second wall portion 709 having a plurality of layers compared to the flexibility of the first wall portion 708 also having a plurality of layers may be implemented by providing a plurality of layers, wherein at least one layer may include a pore structure within the second wall portion 709 of the housing.

Referring to FIG. 8, the greater flexibility of the second wall portion 809 having a plurality of layers compared to the flexibility of the first wall portion 808 also having a plurality of layers may be implemented by providing a plurality of layers, wherein at least one layer may include a meander structure within the second wall portion 809 of the housing.

Thus, other implementations enabling adaptation of the housing 101 to the user's ear canal due to its intrinsic flexibility and therefore a better and much more comfortable fit in the user's ear canal may be provided, which may lead to a better acceptance of the hearing aid by eliminating the problematic locations, and consequently, to less returns of the product.

Figure 9:
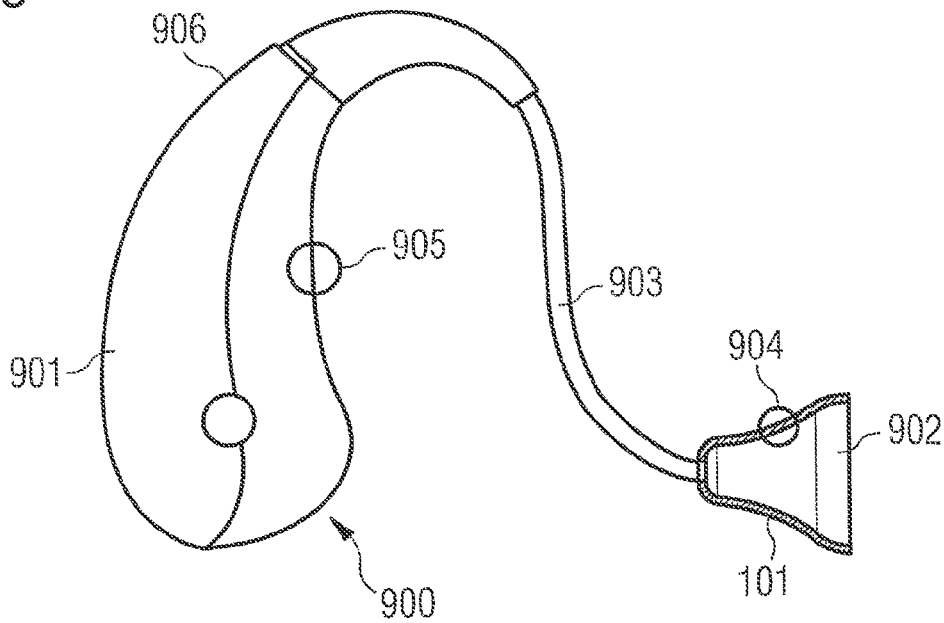
FIG. 9 shows a behind-the-ear (BTE) hearing aid according to an embodiment.

FIG. 9 shows a behind-the-ear (BTE) hearing aid according to one embodiment.

Referring to FIG. 9, a BTE hearing aid 900 may include: a BTE-portion 901, an in-the-ear device 902, and a sound tube 903. Reference numbers 904 and 905, respectively, designate a portion of the wall of the housing 101 of the in-the-ear device 902 of the BTE hearing aid 900 and a portion of the wall of the housing 906 of the behind-the-ear portion 901 of the BTE hearing aid 900, respectively. The portion of the wall of the housing 906 of the behind-the-ear portion 901 designated by reference number 905 may be implemented in the same manner as the portion of the wall of the housing 101 of the in-the-ear device 902 designated by reference number 905, which implementations were explained in more detail above in respect to various possible implementations thereof which are shown in more detail in FIG. 2 to FIG. 8.

Figure 10:
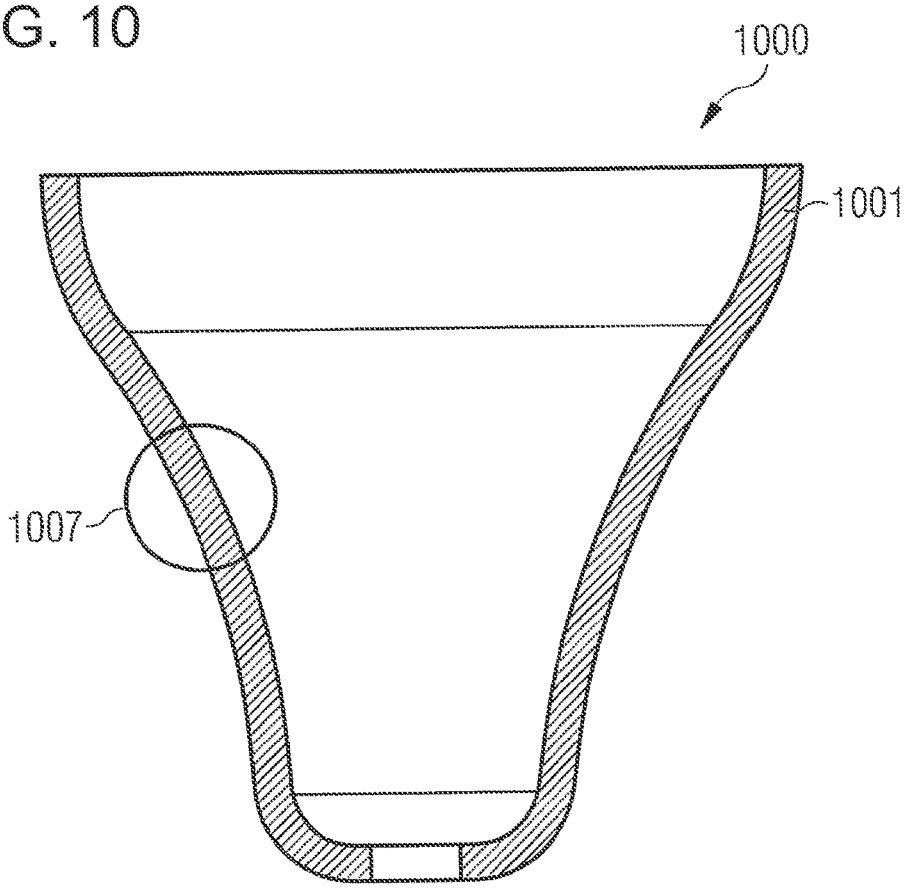
FIG. 10 shows a schematic drawing of an in-the-ear (ITE) device 1000 according to an embodiment.

FIG. 10 shows a schematic drawing of an in-the-ear (ITE) device 1000 according to another embodiment. The in-the-ear (ITE) device 1000 differs from the hearing aid 100 shown in FIG. 1 in that the in-the-ear (ITE) device 1000 is not configured as a hearing aid but e.g. serves as an ear protector. Thus, in various embodiments, the in-the-ear (ITE) device 1000 may be free of any electronic components.

Referring to FIG. 10, the in-the-ear (ITE) device 1000 according to an embodiment may include a housing 1001. Reference number 1007 designates a portion of the wall of the housing 101 which was explained in more detail above in respect to various possible implementations thereof which are shown in more detail in FIG. 2 to FIG. 8.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A hearing aid, comprising:

a hearing aid housing having a first housing wall portion and a second housing wall portion;

said first housing wall portion having a first flexibility, said second housing wall portion having a second flexibility and said first flexibility being different than said second flexibility;

said first housing wall portion having a first wall structure, said second housing wall portion having a second wall structure and said first wall structure being different than said second wall structure and providing said different flexibilities; and said second wall structure being a wall structure selected from a group of wall structures consisting of a grid structure, a pore structure and a meander structure.

2. The hearing aid according to claim 1, wherein the hearing aid is an in-the-ear hearing aid.

3. The hearing aid according to claim 1, wherein the hearing aid is a behind-the-ear hearing aid.

4. The hearing aid according to claim 1, wherein at least one of said housing wall portions is formed of plastic material.

5. The hearing aid according to claim 4, wherein said plastic material is selected from a group of plastic materials consisting of: Tango Plus, Eshell, R11, Y0, Accura 10, Accura 40, FotoTec and Vero White with a shore hardness of from 1 to 100 and a shore hardness difference between the materials of from 1 to 99.

6. The hearing aid according to claim 1, wherein at least one of said housing wall portions is formed of bio-compatible material.

7. The hearing aid according to claim 1, wherein said first flexibility is less than said second flexibility.

8. The hearing aid according to claim 1, wherein:

said first housing wall portion is formed of a first material;

said second housing wall portion is formed of a second material; and said first material is different than said second material.

9. The hearing aid according to claim 8, wherein said first material is a plastic material and said second material is a rubber material.

10. The hearing aid according to claim 8, wherein said first material is a plastic material and said second material is a curable material.

11. The hearing aid according to claim 1, wherein said second housing wall portion includes a plurality of layers.

12. The hearing aid according to claim 11, wherein:

said plurality of layers includes at least one layer having a wall structure selected from a group of wall structures consisting of:

a grid structure;

a pore structure; and a meander structure.

13. The hearing aid according to claim 1, wherein said first housing wall portion has a different physical thickness than said second housing wall portion.

14. The hearing aid according to claim 1, wherein said second housing wall portion has a housing surface with a contacting portion configured to provide a physical contact with the skin of a user when worn by the user.

15. The hearing aid according to claim 14, wherein:

said contacting portion is selected from a group of contacting portions consisting of:

a contacting portion configured to provide a physical contact with a front portion of an ear conch of the user when worn by the user;

a contacting portion configured to provide a physical contact with an ear canal of the user when worn by the user; and a contacting portion configured to provide a physical contact with a back portion of an ear conch of the user when worn by the user.

16. The hearing aid according to claim 1, wherein said second wall portion is provided by a coating material configured to cover a hole in said first housing wall portion and at least a portion of said first wall portion.

17. The hearing aid according to claim 16, wherein said coating material is a flexible coating material.

18. The hearing aid according to claim 16, wherein said coating material is a flexible membrane.

19. An in-the-ear device, comprising:

a housing having a first housing wall portion and a second housing wall portion;

said first housing wall portion having a first flexibility, said second housing wall portion having a second flexibility and said first flexibility being different than said second flexibility;

said first housing wall portion having a first wall structure, said second housing wall portion having a second wall structure and said first wall structure being different than said second wall structure and providing said different flexibilities; and said second wall structure being a wall structure selected from a group of wall structures consisting of a grid structure, a pore structure and a meander structure.

* * * * *